US009693930B2

(12) United States Patent
Gathers

(10) Patent No.: US 9,693,930 B2
(45) Date of Patent: Jul. 4, 2017

(54) WASH BASIN BEING TRANSFORMABLE TO BE PARTICULARLY ADAPTED FOR WOUND IRRIGATION

(71) Applicant: Sekuleo Gathers, River Edge, NJ (US)

(72) Inventor: Sekuleo Gathers, River Edge, NJ (US)

( * ) Notice: Subject to any disclaimer, the term of this patent is extended or adjusted under 35 U.S.C. 154(b) by 0 days.

(21) Appl. No.: 14/806,959

(22) Filed: Jul. 23, 2015

(65) Prior Publication Data

US 2016/0213562 A1 Jul. 28, 2016

Related U.S. Application Data

(63) Continuation-in-part of application No. 14/607,007, filed on Jan. 27, 2015.

(51) Int. Cl.

| | |
|---|---|
| ***B65D 1/34*** | (2006.01) |
| ***B65D 1/40*** | (2006.01) |
| ***A61H 35/00*** | (2006.01) |
| ***A47K 1/04*** | (2006.01) |

(Continued)

(52) U.S. Cl.

CPC ..... *A61H 35/00* (2013.01); *A47K 1/04* (2013.01); *A61H 33/6005* (2013.01); *A61H 35/006* (2013.01); *A61H 2201/0157* (2013.01); *A61H 2201/164* (2013.01); *A61H 2201/1635* (2013.01); *A61H 2201/1645* (2013.01);

(Continued)

(58) Field of Classification Search

CPC ..... A61M 3/02; A61M 27/00; A61M 1/0001; A61M 1/00; A61H 2033/0004; A61H 2033/0012; A61H 33/0087; A61H 35/00; A61H 35/006; A61H 33/6005; A61H 2201/0157; A61H 2201/1635; A61H 2201/164; A61H 2201/1645; A61H 2205/06; A61H 2205/10; A61H 2205/106; A47K 1/04; A61G 7/075

USPC ..... 220/676; 4/621, 622, 644, 645

See application file for complete search history.

(56) References Cited

U.S. PATENT DOCUMENTS

| | | | |
|---|---|---|---|
| 716,096 | A | 12/1902 | Pierce |
| 1,061,769 | A | 5/1913 | Meinecke |
| 1,105,365 | A | 7/1914 | McQuhae |

(Continued)

FOREIGN PATENT DOCUMENTS

GB 2255963 A * 11/1992 ..... B65D 19/00

*Primary Examiner* — J. Gregory Pickett
*Assistant Examiner* — Niki M Eloshway
(74) *Attorney, Agent, or Firm* — Thomas A. O'Rourke; Bodner & O'Rourke, LLP

(57) ABSTRACT

A hospital-grade basin holds water for washing patients, or alternatively converts easily/quickly for a patient's limb to rest comfortably within and across a portion of the basin. In a first embodiment, half-moon shaped openings on opposite sides of the basin side wall(s) comfortably support the limb at a reduced height with respect to adjacent side wall portions, which serve as a partial shield during wound irrigation, and aid fluid collection. The shaped openings may each be sealed with a hinged door in a closed position, using a friction fit, to form the traditional, watertight basin. In an alternate embodiment, the doors may be secured in the closed position using an elastomeric leaf-spring-shaped member. In other embodiments, rather than cutouts and doors, opposing portions of the side wall may instead be formed of an over-molded elastomeric material that conforms to the patient's limb, or may instead be formed like a bellows.

3 Claims, 26 Drawing Sheets

(51) Int. Cl.
*A61H 33/00* (2006.01)
*B65D 1/22* (2006.01)

(52) U.S. Cl.
CPC ..... *A61H 2205/06* (2013.01); *A61H 2205/10* (2013.01); *A61H 2205/106* (2013.01)

(56) References Cited

U.S. PATENT DOCUMENTS 1,374,685 A 4/1921 Steinkamp
1,775,442 A 9/1930 Sarason
D120,214 S 4/1940 Carson
2,469,184 A 5/1949 Thomas
2,475,259 A 7/1949 Singleton
2,486,824 A 11/1949 Daniels
2,709,435 A 5/1955 Kress
3,015,110 A 1/1962 Treand
3,083,376 A 4/1963 Johns
D197,106 S 12/1963 Laubsch
3,288,140 A 11/1966 McCarthy
3,458,080 A 7/1969 Laurizio
3,465,370 A 9/1969 Chernick
D220,928 S 6/1971 Bost
3,611,450 A 10/1971 Bost
3,733,620 A 5/1973 Glintz
3,851,340 A 12/1974 Keusch
4,024,590 A 5/1977 Wendt
4,152,792 A 5/1979 Glintz
4,290,249 A 9/1981 Mass
4,368,548 A 1/1983 Glass
4,864,667 A 9/1989 Adams
5,245,713 A 9/1993 Tickle
5,261,130 A 11/1993 Kendall
5,309,794 A 5/1994 Kelly
5,312,385 A 5/1994 Greco
5,381,562 A 1/1995 Holloway
5,393,299 A 2/1995 Brettin
5,697,921 A 12/1997 Blair
D398,075 S 9/1998 Book
5,816,433 A * 10/1998 Higgins ..... A45C 11/20 220/503
5,848,998 A 12/1998 Marasco
5,860,947 A 1/1999 Stamler
D405,526 S 2/1999 Bonelli
5,941,859 A 8/1999 Lerman
6,161,227 A * 12/2000 Bargenquast ..... A47K 1/04 134/58 R
6,210,382 B1 4/2001 Hogg
6,398,062 B1 6/2002 Jones
6,405,389 B1 6/2002 Harty
6,458,109 B1 10/2002 Henley
6,558,344 B2 5/2003 McKinnon
6,609,257 B1 8/2003 O'Geary
6,755,196 B2 6/2004 Musso
6,755,807 B2 6/2004 Risk, Jr.
D546,943 S 7/2007 Kammer
7,641,835 B2 * 1/2010 Ramsey ..... B65F 1/06 220/495.08
7,736,348 B2 6/2010 Booth
D621,927 S * 8/2010 Dominguez ..... D24/121
7,785,303 B2 8/2010 Tapadiya
7,794,438 B2 9/2010 Henley
8,434,491 B2 5/2013 Born
8,617,130 B2 12/2013 Ray
8,672,179 B2 * 3/2014 Bradley ..... E05D 7/1005 220/254.3
2002/0083516 A1 7/2002 Wing
2002/0146955 A1 * 10/2002 Levine ..... A61F 13/0203 442/328
2003/0056285 A1 3/2003 Pollastri
2003/0168461 A1 * 9/2003 Richardson ..... B65F 1/02 220/661
2004/0225265 A1 * 11/2004 Tapadiya ..... A61H 35/00 604/317
2005/0178770 A1 * 8/2005 Hase ..... B65D 25/005 220/592.2
2008/0315141 A1 * 12/2008 Thrash ..... F16K 51/02 251/170
2009/0261108 A1 * 10/2009 Steinberg ..... D06F 39/081 220/571
2010/0218780 A1 9/2010 Hurman
2011/0225726 A1 9/2011 Dominguez
2012/0222210 A1 9/2012 Wiggins
2012/0227177 A1 9/2012 Kiser
2012/0246820 A1 10/2012 Huynh
2015/0305573 A1 * 10/2015 Stafford ..... A47K 3/006 4/555
2015/0328393 A1 * 11/2015 Stephens ..... A61G 7/0755 4/621

* cited by examiner

| STANDING HEIGHT (A) | | |
|---|---|---|
| % | Male | Female |
| 5 | 64.6" | 59.5" |
| 50 | 68.8" | 63.6" |
| 95 | 73.2" | 67.7" |

| UPPER ARM LENGTH (B) | | |
|---|---|---|
| % | Male | Female |
| 5 | 10.4" | 9.8" |
| 50 | 11.1" | 10.4" |
| 95 | 11.9" | 11.1" |

| FOREARM LENGTH (C) | | |
|---|---|---|
| % | Male | Female |
| 5 | 9.2" | 8.6" |
| 50 | 10.0" | 9.2" |
| 95 | 10.6" | 10.0" |

| THIGH LENGTH (D) | | |
|---|---|---|
| % | Male | Female |
| 5 | 15.3" | 13.9" |
| 50 | 16.7" | 15.3" |
| 95 | 18.1" | 16.6" |

| SHIN LENGTH (E) | | |
|---|---|---|
| % | Male | Female |
| 5 | 14.8" | 13.5" |
| 50 | 16.2" | 14.8" |
| 95 | 17.7" | 16.1" |

| THIGH CIRCUMFERENCE (A) | | |
|---|---|---|
| % | Male | Female |
| 5 | 17.5" | 16.7" |
| 50 | 21.2" | 20.3" |
| 95 | 25.4" | 26.5" |

| THIGH DEPTH (B) | | |
|---|---|---|
| % | Male | Female |
| 5 | 6.2" | 5.9" |
| 50 | 7.1" | 6.9" |
| 95 | 8.1" | 7.9" |

| THIGH WIDTH (C) | | |
|---|---|---|
| % | Male | Female |
| 5 | 5.8" | 5.7" |
| 50 | 6.6" | 6.9" |
| 95 | 7.5" | 8.4" |

| CALF CIRCUMFERENCE (D) | | |
|---|---|---|
| % | Male | Female |
| 5 | 13.2" | 12.5" |
| 50 | 15.4" | 14.8" |
| 95 | 18.3" | 18.5" |

| MID-ARM CIRCUMFERENCE (E) | | |
|---|---|---|
| % | Male | Female |
| 5 | 10.8" | 9.6" |
| 50 | 13.3" | 12.2" |
| 95 | 16.3" | 16.5" |

| MID-ARM WIDTH (F) | | |
|---|---|---|
| % | Male | Female |
| 5 | 3.3" | 2.8" |
| 50 | 3.9" | 3.3" |
| 95 | 4.7" | 3.9" |

| FOREARM WIDTH (H) | | |
|---|---|---|
| % | Male | Female |
| 5 | 3.2" | 2.7" |
| 50 | 3.7" | 3" |
| 95 | 4.1" | 3.5" |

WASH BASIN BEING TRANSFORMABLE TO BE PARTICULARLY ADAPTED FOR WOUND IRRIGATION

CROSS REFERENCE TO RELATED APPLICATIONS

This application is a continuation-in-part of U.S. application Ser. No. 14/607,007, filed on Jan. 27, 2015, the disclosures of which are incorporated herein by reference.

FIELD OF THE INVENTION

The present invention relates to improvements in hospital basins, and more particularly to improvements in a basin being usable for retaining water for sponge bathing of a patient or for emesis, or a basin being alternatively and particularly adapted for irrigating wounds, each of which may be efficiently accomplished using the transformable basin of the present invention.

BACKGROUND OF THE INVENTION

A basin, particularly at a hospital and other facility that cares for patients, may be used for washing of the patient (i.e., a sponge bath). An example of such a basin is shown, for example, by U.S. Pat. No. 3,611,450 to Bost, and by U.S. Design patent No. D546,943 to Kammer. This type of basin may also be used for carrying fluids, carrying tools, as a hospital admission kit, as a waste bin, or the basin may be further adapted to serve as an emesis basin, as shown by U.S. patent Design No. D197,106.

A number of prior art devices have been developed to be more particularly adapted for irrigating a patient's wounds. Several examples of such devices are shown by U.S. Pat. No. 2,709,435 to Kress, U.S. Pat. No. 6,609,257 to O'Geary, U.S. Pat. No. 7,785,303 to Tapadiya, U.S. Patent Application Pub. No. 2011/0225726 to Dominguez, and U.S. Patent Application Pub. No. 2012/0222210 to Wiggins.

However, none of the prior art basins are adapted to efficiently and effectively serve in both roles. Certain basin embodiments disclosed herein are each adapted to transform to be effectively used for either purpose.

DETAILED DESCRIPTION OF THE INVENTION

Figure 1:
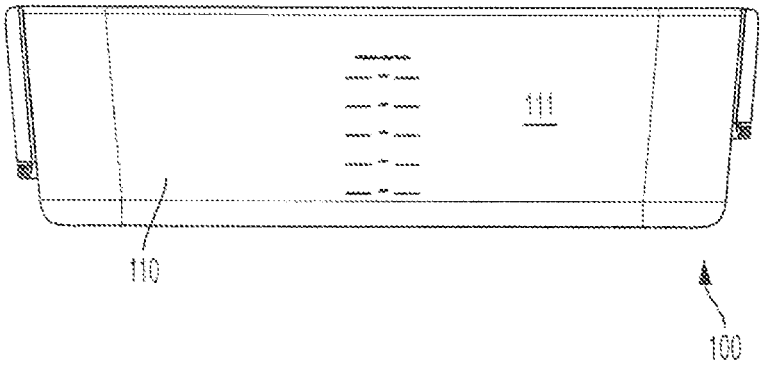
FIG. 1 is a front view of a first embodiment of a basin built in accordance with the present invention, having opposing hinged doors that are shown in a closed position.

Referring to the embodiment shown in FIGS. 1, 2, 3, and 4, a basin with opposing hinged doors 100 is shown as a four-sided tub member 110 that includes a first side wall 111, a second, side wall 112, a large door side wall 113, and a small door side wall 114, each of which extend up from a tub floor 115. In this embodiment, the tub member 110 is defined by a rectangular shape with the first side wall 111 and the second side wall 112 defining its longitudinal sides. It is contemplated, however, that in other embodiments the large door side wall 113 and small door side wall 114 may define the longitudinal sides, or the tub member 110 may be defined by an alternate shape suitable for a basin, such as a kidney shape, a round shape, an oval shape, etc. It is additionally contemplated that the tub member 110 may be constricted in a range of sizes, whether to accommodate different body parts or just different size requirements for different patients.

In this embodiment, the large door side wall 113 includes a large door frame section 130 and the small door side wall 114 includes a small door frame section 140. The large door frame section 130 outlines a semi-circular shaped large opening extending down from the top of the large door side wall 113 into the body of the large door side wall 113. The large door frame section 130 includes a large mounting frame 131 which defines a frame structure that extends around the border of the large opening that extends into the large door side wall 113, thereby creating a large border surface area 132 having increased thickness relative to the thickness of the large door wall 113. The large opening may have, for example, a diameter of 5.5 inches, resulting in it extending 5.5 inches wide across the large door side wall 113 at the widest point and 2.75 inches into the large door side wall 113 at its deepest point.

Figure 2:
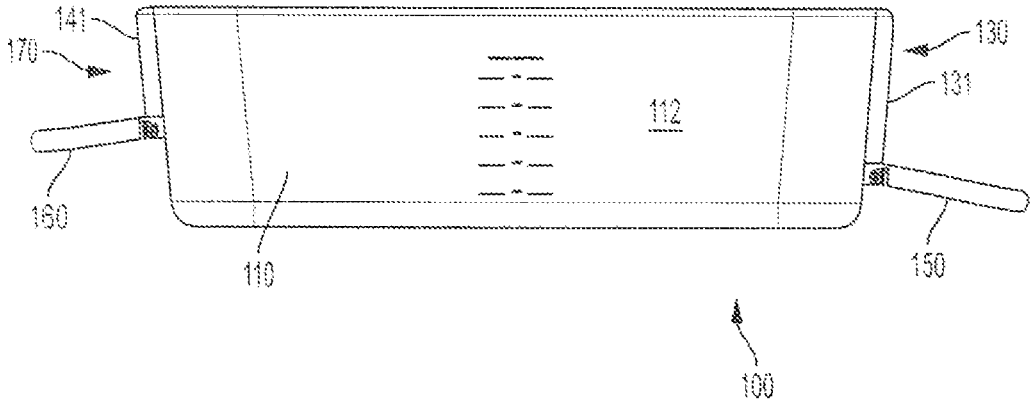
FIG. 2 is a rear view of the tub member and hinged doors of the basin of FIG. 1, but shown with its doors in an open position.
Figure 3:
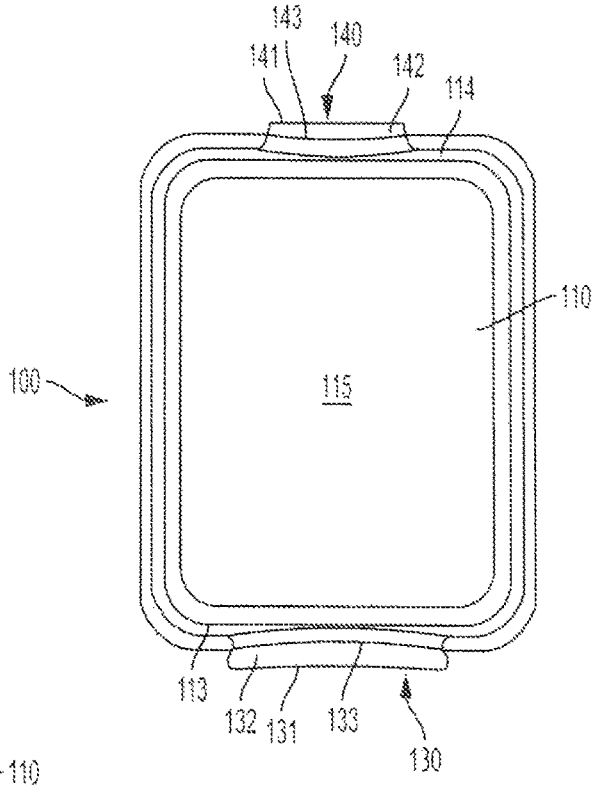
FIG. 3 is a top view of the basin of FIG. 1.
Figure 4:
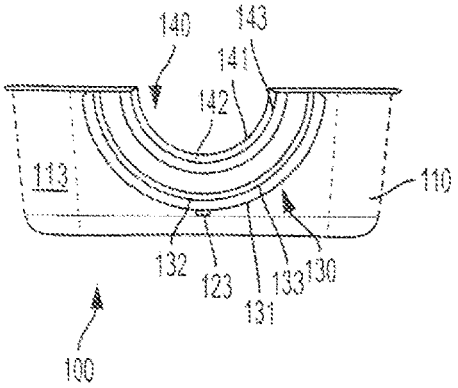
FIG. 4 is an end view of the basin of FIG. 1.
Figure 5:
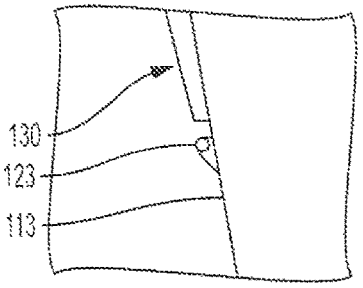
FIG. 5 is the view of FIG. 2, but shown enlarged and without the hinged door.
Figure 6:
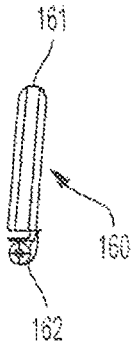
FIG. 6 is a side view of a small door used for the basin of FIG. 1.
Figure 8:
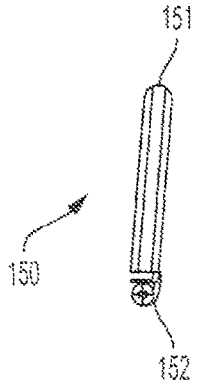
FIG. 8 is a side view of a large door used for the basin of FIG. 1.
Figure 7:
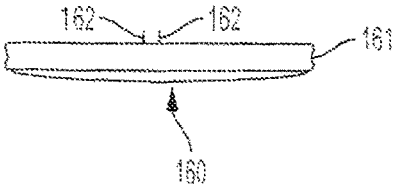
FIG. 7 is a top view of the small door of FIG. 6.
Figure 9:
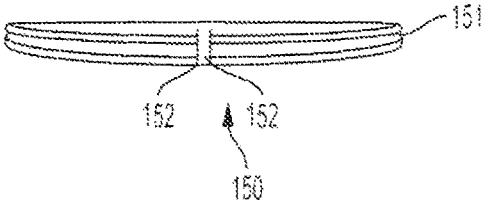
FIG. 9 is a bottom view of the large door of FIG. 8.
Figure 10:
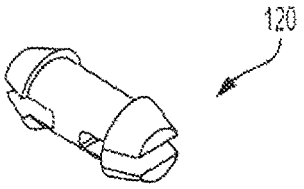
FIG. 10 is a perspective view of the fastening pin used for the pivotal mounting of the hinged doors for the basin of FIG. 1.
Figure 11:
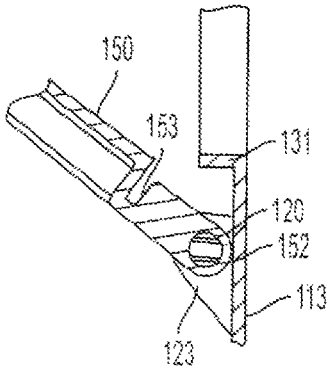
FIG. 11 is a cross-sectional view of the side wall of the tub member and the corresponding door of a basin with opposing hinged doors built in accordance with the present invention, with the door shown in the open position.
Figure 12:
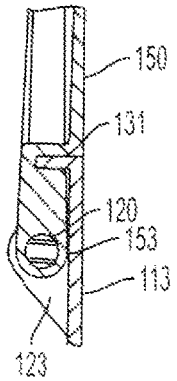
FIG. 12 is a side elevational view of a section of the side wall of the tub member and corresponding door of a basin with opposing hinged doors built in accordance with the present invention with the door in the closed position.

The large door frame section 130 may have a large door member ISO pivotally attached thereto, and sized to fit into the large mounting frame 131, thereby allowing it to be moved into a closed position in the large door frame section 130, as illustrated by FIG. 1, into an open position relative to the large door frame section 130, as illustrated in FIG. 2, as well as into other positions between the closed and open positions. It is contemplated, however, that the large door frame section 130 and corresponding large door member 150 may together be constructed in alternate shapes and different sizes relative to the large door side wall 113.

The small door side wall 114 may be structured in a similar manner as the large door side wall 113, with the only substantive difference being that the small door frame section 140 is smaller than the large door frame section 130. Accordingly, the small door frame section 140 outlines a semicircular shaped small opening extending down from the top of the small door side wall 114 into the body of the small door side wall 114. The small door frame section 140 includes a small mounting frame 141 which defines a frame structure that extends around the border of the small opening that extends into the small door side wall 114, thereby creating a small border surface area 142 having increased thickness relative to the thickness of the small door side wall 114. In this embodiment, the small opening has a diameter of 4 inches, resulting in it extending 4 inches wide across the small door side wall 114 at the widest point and 2 inches into the small door side wall 114 at its deepest point.

The small door frame section 140 may have a small door member 160 pivotally attached thereto, and sized to fit into the small mounting frame 141, thereby allowing it to be moved into a closed position in the small door frame section 140, as illustrated in FIG. 1, into an open position relative to the small door frame section 140, as Illustrated in FIG. 2, as well as into other positions between the closed and open positions. It is contemplated, however, that the small door frame section 140 and corresponding small door member 160 may together be constructed in alternate shapes and sizes relative to the small door side wall 114.

It is contemplated that by including the large door frame section 130 and the small door frame section. 140, the tub member 110 may provide a modified basin means for collecting debris, water, run-off materials or specimens. Further, by corresponding to the respective large door frame section 130 and the small door frame section 140, the large door member 150 and small door member 160 each provide a door means for selectively opening and closing an entry point in the tub member 110.

Referring now to FIGS. 3, 4, 5, 6, 7, 8, 9, 10, 11, and 12, the large border surface area 132 and small border surface are 142 each include a centrally disposed ridge member 133, 143 running longitudinally through it. The ridge members 133, 143, along with corresponding centrally disposed recesses 151, 161 in large door member 150 and small door member 160, respectively, provide a locking means for securing the large door member 150 and small door member 160 in the large door frame section 130 and small door frame section 140, respectively, when the respective door member is in the closed position. The locking means is operative to allow the large door member 150 to snap into the large door frame section 130 when the large door member 150 is moved to the closed position. In this regard, when the large door member 150 is moved to the closed position, the ridge member 133 frictionally passes along the circumferential surface of the large door member 150 as it moves toward the closed position and engages the recess 151 once the large door member 150 is in the closed position (i.e., is retained therein in a friction fit). When secured in the closed position, the large door member 150 is operative to close off the large opening outlined by the large door frame section 130, and forms a watertight seal.

The locking means operates in essentially the same manner with the small door member 160 and the small door frame section 140. Thus, the small door member 160 snaps into the small door frame section 140 when the small door member 160 is moved to the closed position. When the small door member 160 is moved to the closed position, the ridge member 143 frictionally passes along the circumferential surface of the small door member 160 as it moves toward the closed position and engages the recess 161 once the small door member 160 is in the closed position. As with the large door member, when the small door member 160 is secured in the closed, position, it closes off the small opening outlined by the small door frame section 140 and forms a watertight seal.

A small door hinge mechanism enables the small door member 160 to be pivotally attached to the small door side wall 114. The small, door hinge mechanism is defined by two hinge attachment arms 162 which extend down from the bottom of the small door member 160, a small wall receiving member (not shown, but identical to the large wall receiving member 123 discussed below) which extends out from the side of the small door side wall 114 underneath the small door frame section 140, and a fastening pin 120. The fastening pin 120 is structured to pass transversely through holes in both the small wall receiving member and the two hinge attachment arms 162 and remain fixed therein, thereby forming a pivot axis about which the small door member 160 rotates relative to the small door side wall 114.

The large door member 150 and large door side wall 113 are connected through a large door hinge mechanism, which employs the same type of components as the small door hinge mechanism. Accordingly, the large door hinge mechanism is defined by two hinge attachment arms 152 which extend down from the bottom of the large door member 150, a large wall receiving member 123 which extends out from the side of the large door side wall 113 underneath the large door frame section 130, and another fastening pin 120. As with the small door hinge mechanism, the fastening pin 120 is structured to pass transversely through holes in both the large wall receiving slot member 123 and the two hinge attachment arms 152 and remain fixed therein, thereby forming a pivot axis about which the large door member 150 rotates relative to the small door side wall 113.

In this embodiment, a secondary locking means may be included for securing the large door member 150 and small door member 160 in the large door frame section 130 and small door frame section 140 respectively, when the respective door member is in the closed position. The second locking means, as illustrated on the large door side wall 113 in FIGS. 11 and 12, may include a locking recess 153 formed in the area between the two hinge attachment arms 152 and the large door member 150 and the abutment formed by large mounting frame 131 as it extends outward from the large door side wall 113. The corresponding locking recess 153 and abutment engage when the large door member 150 is in the closed position relative to the large door frame section 130, thereby providing a supplemental lock for keeping the large door member 150 in place. It is understood that the small door member 160 and small door frame section 140 include identical structures, thereby enabling such a supplemental lock in their operation.

Figure 13:
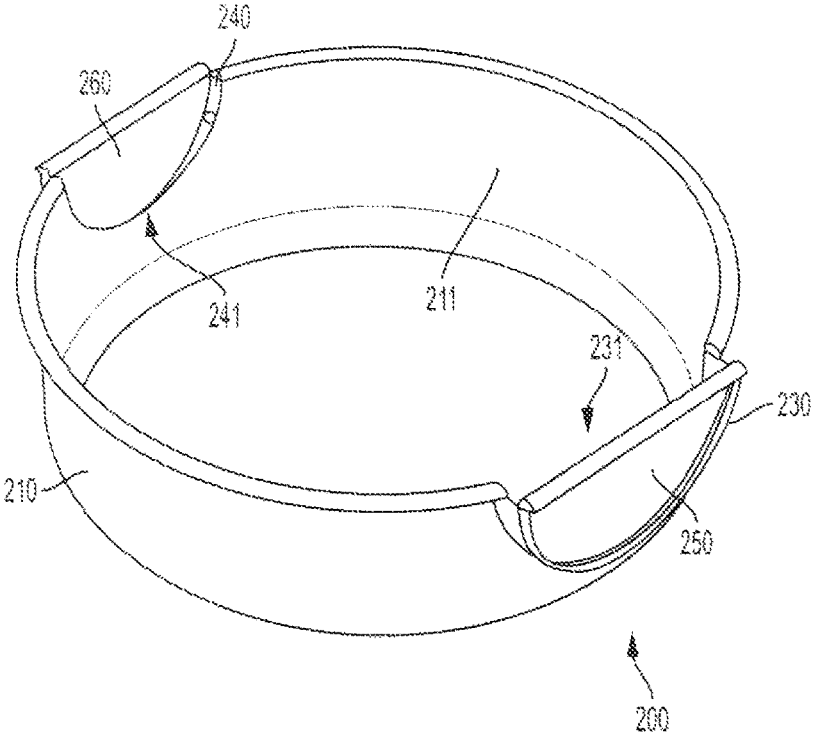
FIG. 13 is a side perspective view of a basin with opposing hinged doors built in accordance with a round embodiment of the present invention having its doors in the closed position.

Referring now to FIG. 13, an alternate embodiment of a basin with opposing hinged doors 200 is shown as a circular tub member 210 with a circumferential side wall 211 that includes a large door frame section 230 surrounding a large opening 231 and small door frame section 240 surrounding a small opening 241. As with the rectangular embodiment, integral with the large door frame section 230 is a large door member 250 sized to fit into the large opening 231, thereby allowing it to be moved into a closed position in the large door frame section 230 and integral with the small door frame section 240 is a small door member 260 sized to fit into the small opening 241, thereby allowing it to be moved into a closed position in the small door frame section 240. It is contemplated that the large door frame section 230 and large door member 250 and the small door frame section 240 and small door member 260, respectively, are operative to move between an open and closed position in the same manner as described above for the rectangular embodiment.

It is also contemplated that for any of the above described embodiments, that the large and small door members may alternatively be configured to pivot inwardly into the basin to be in the open position.

Figure 14:
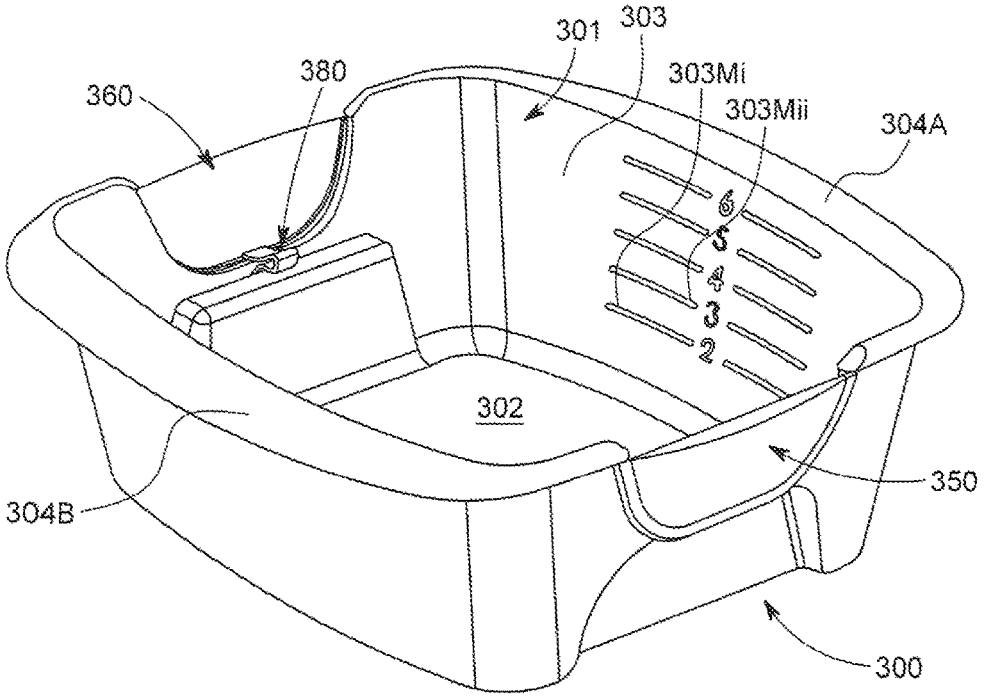
FIG. 14 is a perspective view of a second embodiment of a basin built in accordance with the present invention, having opposing hinged doors.

FIG. 14 illustrates a perspective view of another embodiment of a basin formed in accordance with the present invention. Basin assembly 300 may include a tub portion 301 that is formed with a substantially flat base 302, from which may upwardly extend a wall 303. Wall 303 may be integrally formed with base 302, and may be formed as a single continuous member, which, as noted above, may be formed to be any desired shape including a circular shape, a rectangular shape, etc. Merely to be illustrative, a rectangular shape is shown throughout FIGS. 14-47. The wall 303 may have markings 303Mi, 303Mii, etc., integrally formed therein, or stenciled thereon, to indicate the fluid level (e.g., 2 liter, 3 liters, etc.).

Figure 18:
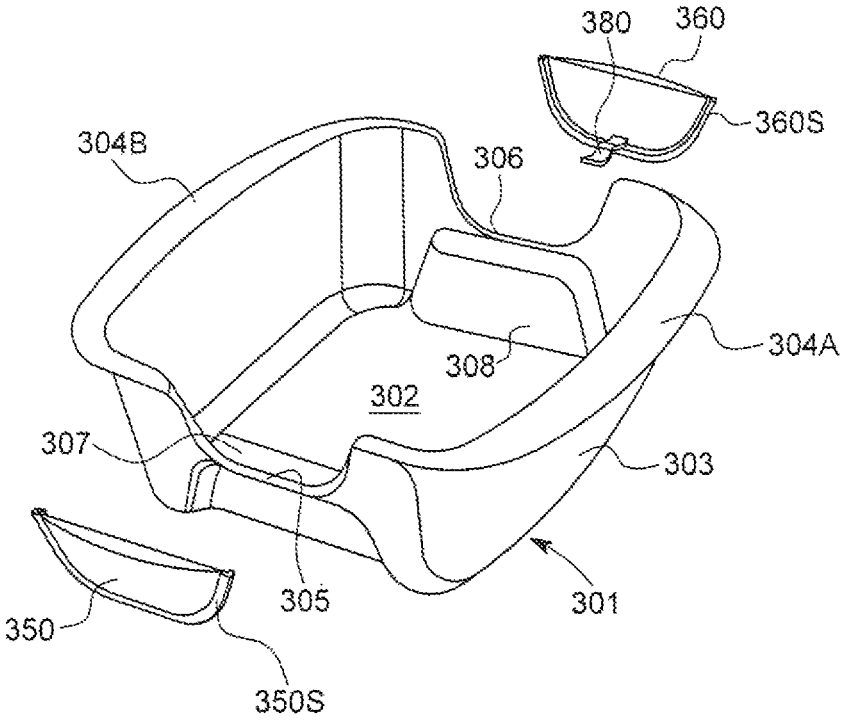
FIG. 18 is a reverse perspective view of the basin of FIG. 14, showing the doors prior to attachment to the tub portion.

A first set of opposing portions of the top of the wall 303 may have a return flange that forms a first lip 304A and a second lip 304B, which may be used for carrying and handling of the basin assembly 300. The return flange that forms the lip 304A and 304B may gradually reduce in size, until no lip is formed at the top of wall 303. A second set of opposing portions of the wall 303 may not have a lip formed thereat, and each of those portions may instead have a reduced height wall area, as seen in FIG. 18.

A first reduced height wall area 305 may have a central portion being substantially horizontal, which may then gradually transition upwardly at each end to the full wall height. Alternatively, the reduced height area may be semi-circular, or half-moon shaped, as described above. The second reduced height area 306 may be formed the same as the first reduced height area 305, being formed to have the same height and length and transition. Alternatively, any or all of the dimensions of the second reduced height area may be different than the first reduced height area (i.e., the first and second reduced height areas may be different as the unique shape may accommodate different sized door panels, discussed hereinafter).

Figure 24:
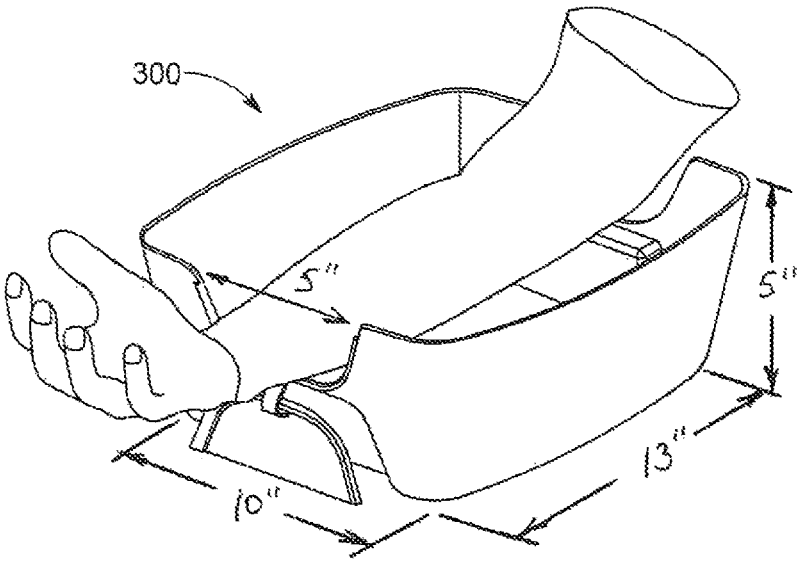
FIG. 24 is a reverse perspective view of the basin of FIG. 14, but shown with the door in the unsealed position, and with a patient's arm extending across the two reduced height wall areas, in preparation for wound irrigation therein.

The reduced height areas 305 and 306 of wall 303 may permit a patient's limb to extend out from those openings, with a wounded portion of the limb being positioned over the base 302 of tub 301, as seen for example in FIG. 24, to undergo irrigation therein. To help provide ergonomic support for the patient's limb, the wall 303 may have a first inward bulge 307 and a second inward bulge 308 respectively formed at the first reduced height area 305 and the second reduced height area 306. The extent of the inward bulge may serve to provide an area of sufficient width, so as to be comfortable when supporting the patient's limb, rather than the limb merely being supported, by a narrow flange that may dig into the skin of the person's arm or leg. The underside of the inward bulges 307 and 308 may also serve as a stable set of handles for lifting of the basin assembly 300, instead of using the lip 304A/304B, particularly when it may contain a substantial quantity of fluid therein.

The first reduced height wall area 305 and the second reduced height wall, area 306 may each be releasably sealed using a door panel, so that the basin may be capable of holding fluid all the way up to the top of wall 303 (i.e., at a level above the reduced height wall areas). A first door panel 350 may be configured to releasably seal the first reduced height area 305, and a second door panel 360 may similarly be configured to releasably seal the second reduced height area 306. Each door panel may be formed of a suitable material, including, but not limited to, polypropylene-based thermoplastic elastomer.

To effectively seal the reduced height areas of wall 303, each of the door panels 350 and 360 may be respectively shaped to correspond to a portion of the periphery of the first reduced height area 305 and the second reduced height area 306. To releasably seal the reduced height areas of wall 303, each of the door panels 350 and 360 may be mounted to the tub 301 using respective elastomeric spring members 370 and 380.

Figure 19:
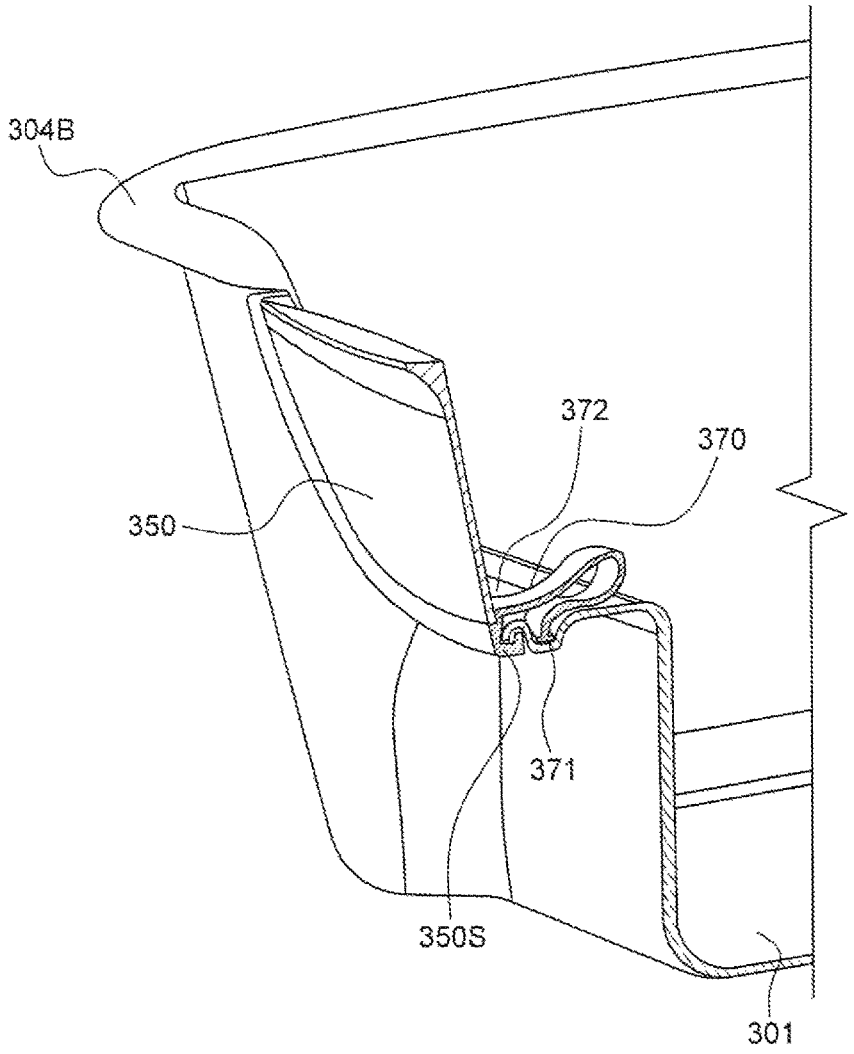
FIG. 19 is an enlarged perspective section view through the tub and one of the doors and its elastomeric spring, for the basin of FIG. 14.

As seen in FIG. 19, a first end 371 of the elastomeric spring member 370 may be fixedly secured to a portion of the tub 301 proximate to the top of the first reduced height area 305, and a second end 372 of the spring member may be fixedly secured to a corresponding location on the door panel 350. The ends of each of the elastomeric spring members 370/380 may each be fixedly secured to the tub 301 and respective door panels 350/360 using any suitable attachment means, including, but not limited to, adhesive, mechanical fasteners, ultrasonic welding, etc., or any combination of the above.

Figure 20:
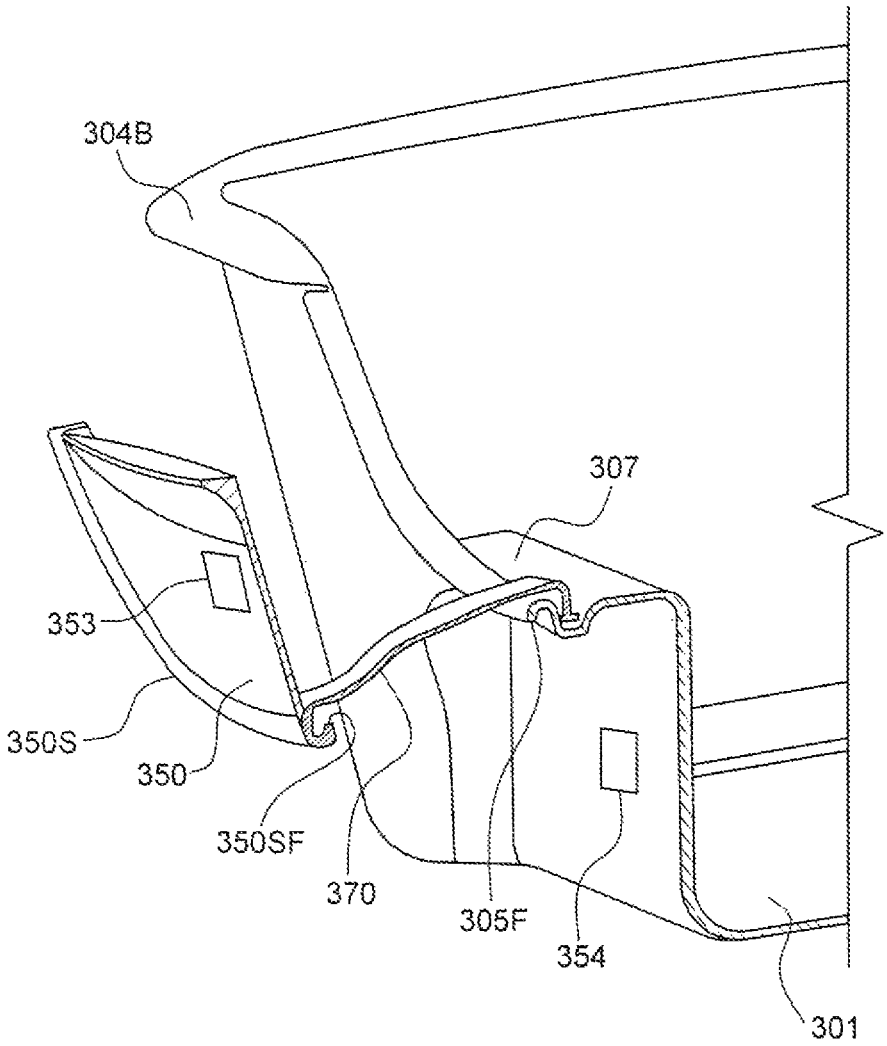
FIG. 20 is the section view of FIG. 19, but shown with the door actuated away from its sealed position against the tub.

When the nurse or other medical practitioner desires to use the basin assembly 300 for wound irrigation of a patient's limb, he/she may move the door panels 350/360 away from the first and second reduced height areas 305/306 of the wall 303, causing the elastomeric spring members 370/380 to deform elastically, as shown generally in FIG. 20.

To releasably retain the door panels 350/360 away from the sealed position at each of the reduced height areas of wall 303, hook and loop fastening materials (e.g., Velcro®) may be used. As shown in FIG. 20, a first piece 353 of the hook and loop fastening material (either the hook material or the loop material) may be fixedly secured to the exterior of the door panel 350, and the corresponding piece of material 354 (the other of the hook material or loop material) may be fixedly secured to the tub 301. When the door panel 350 is displaced from its sealed position it may be secured using the Velcro to be as shown in FIG. 24. The size of the pieces (353/354) of hook and loop materials, and the peel strength may be selected to be able to withstand separation due solely to the restoring force provided by the elastomeric spring member 370 so that the door panel may only be returned to the sealed position by being detached by the nurse or other medical personnel. The door panel 360 may similarly be secured using hook and loop materials.

To enhance, the leak-proof nature of the door panels 350/360, which, are biased into contact with the tub 301 by the elastomeric spring members 370/380, each panel may be made of a stiff plastic material, and the faying portion of its edge may have a more pliable seal member 350S/360S fixedly attached thereto, as seen in FIG. 20. The respective seal members 350S/360S may be formed of a suitable material, which may include, but is not limited to, PTFE, nitrile, neoprene, EPDM rubber, fluorocarbon, silicone, etc.

To further enhance the leak-proof nature of the door panels 350/360 being biased into contact with the tub 301, the reduced height areas 305/306 of the wall 303 may have respective curved flanges 305F/306F protruding outwardly therefrom (FIG. 20), which may form a wedge-shaped opening. The corresponding portion of the seal members 350S/360S on each door panel may be formed to have a similar wedge-shaped flange 350SF, so that the biasing provided by the elastomeric spring members 370/380 may cause the seal members to become wedged within the wedge-shaped opening formed by the curved flange of the reduced height wall areas 305/306 of the wall 303, as seen generally in FIG. 19.

Figure 21:
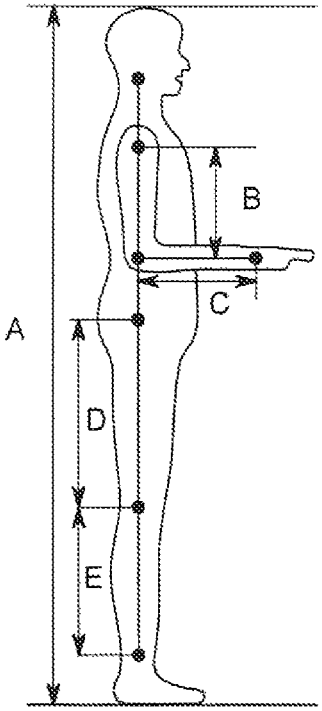
FIG. 21 illustrates the dimensions for certain features of the $5^{th}$ percentile male and female, the $50^{th}$ percentile male and female, and the $95^{th}$ percentile male and female.
Figure 22:
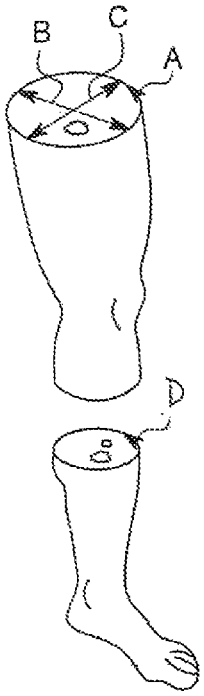
FIG. 22 illustrates the dimensions for certain features of the thigh and calf for the $5^{th}$ percentile male and female, the $50^{th}$ percentile male and female, and the $95^{th}$ percentile male and female.
Figure 23:
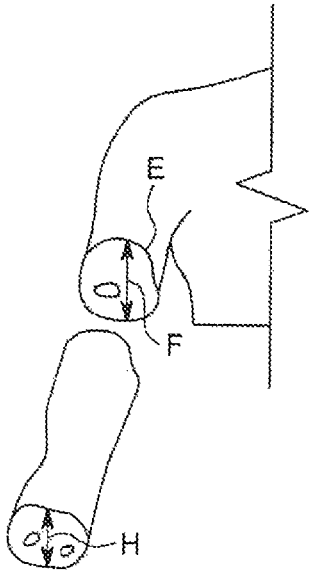
FIG. 23 illustrates the dimensions for certain features of the mid-arm and forearm for the $5^{th}$ percentile male and female, the $50^{th}$ percentile male and female, and the $95^{th}$ percentile male and female.

FIGS. 21-23 illustrate key anatomical dimensions for each of the $5^{th}$ percentile man and woman, the $50^{th}$ percentile man and woman, and the $95^{th}$ percentile man and woman, which are useful for determining suitable sizes for the door panels 350/360, and corresponding sizes/shapes for the reduced height wall areas 305/306 of the wall 303.

Figure 25:
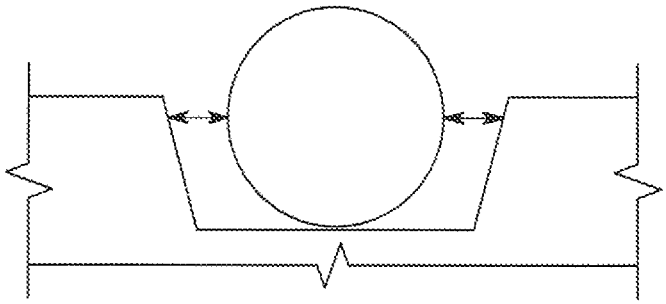
FIG. 25 is an idealized side view showing a representative arm cross-section resting upon the top of the reduced height wall area, and showing the clearances that would be obtained between the arm and the transitional portions of the reduced height wall area.

FIG. 24 illustrates a patient's forearm disposed across the reduced height wall areas 305/306 of basin assembly 300, and resting on the inward bulges 307 and 308. As shown therein a live inch separation may be used at the largest gap tor each of the reduced height areas. FIG. 25 illustrates a cross-sectional view of the arm at the reduced height wall area, and the clearance afforded the arm. A five inch gap would provide adequate clearance for the largest arm dimensions of the $95^{th}$ percentile man (i.e., from FIG. 23, 4.7 inch mid-arm width and 4.1 inch forearm width), which would also provide clearance for the $95^{th}$ percentile woman, with the woman's features each being correspondingly smaller than the man's features. Alternatively, a 5.25 inch or a 5.5 inch gap may be used to provide additional clearance for the $95^{th}$ percentile man. Also, different sized door panels 350/360, and corresponding reduced height wall areas 305/306 may be used at the two locations (i.e., a smaller door panel for the forearm and a larger door panel for the mid-arm). However, use of the same size door panels eliminates the need to specifically orient the basin assembly during use, to match the larger and smaller basin openings with the patient's forearm and mid-arm.

Figure 26:
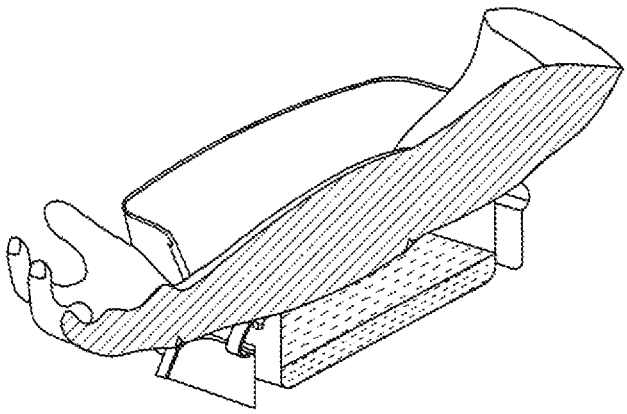
FIG. 26 is a perspective cross-sectional, view of the basin of FIG. 24, shown with two liters of water in the bottom of the tub.

FIG. 26 illustrates that for the use of a panel assembly with a base width of roughly ten inches, a length of approximately 15 inches, a wall height of five inches, and a reduction in wall height of roughly 2.5 inches, that two liters of saline solution would fill approximately one-half of the basin volume below the door opening.

Figure 27:
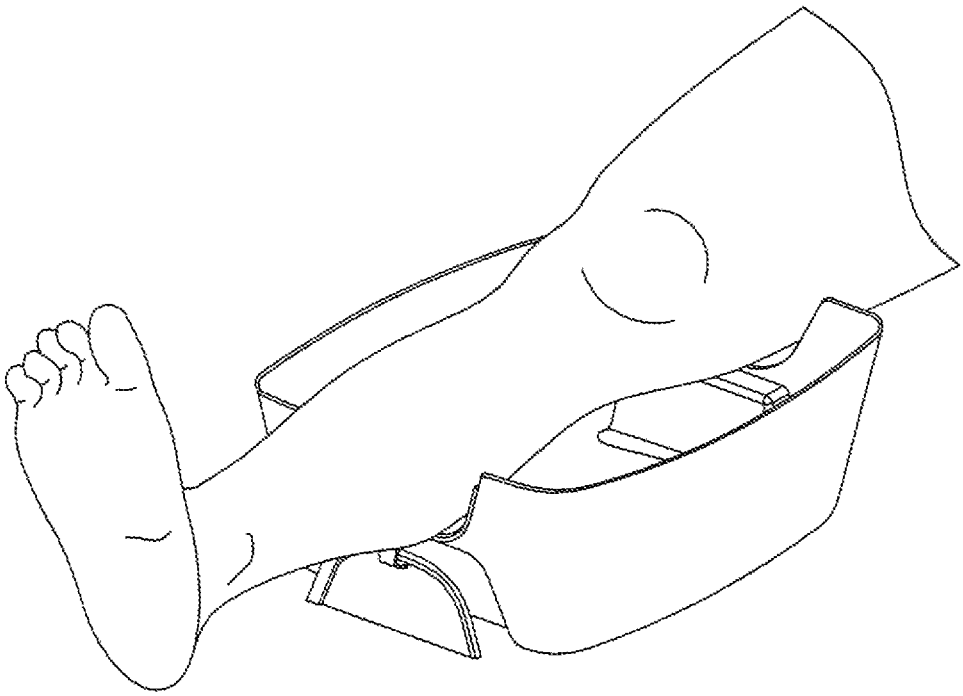
FIG. 27 is a reverse perspective view of the basin of FIG. 14, but shown with the door in the unsealed position, and with a patient's leg extending across the two reduced height wall areas, in preparation for wound irrigation therein.
Figure 28:
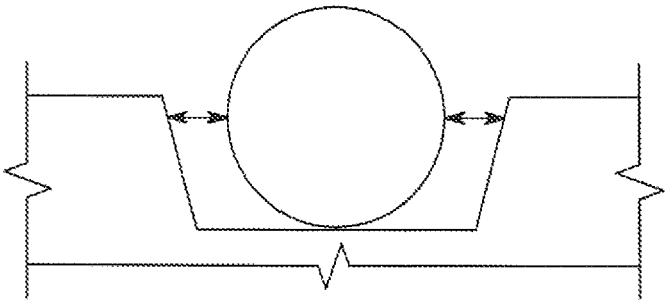
FIG. 28 is an idealized side view showing a representative leg cross-section resting upon the top of the reduced height wall area, and showing the clearances that would be obtained between the leg and the transitional portions of the reduced height wall area.

FIGS. 27-28 illustrate that a larger gap may be needed for use of the basin assembly 300 for wound irrigation of a patient's leg (i.e., as seen in FIG. 22, the $95^{th}$ percentile thigh width of a man is 7.5 inches).

Figure 29:
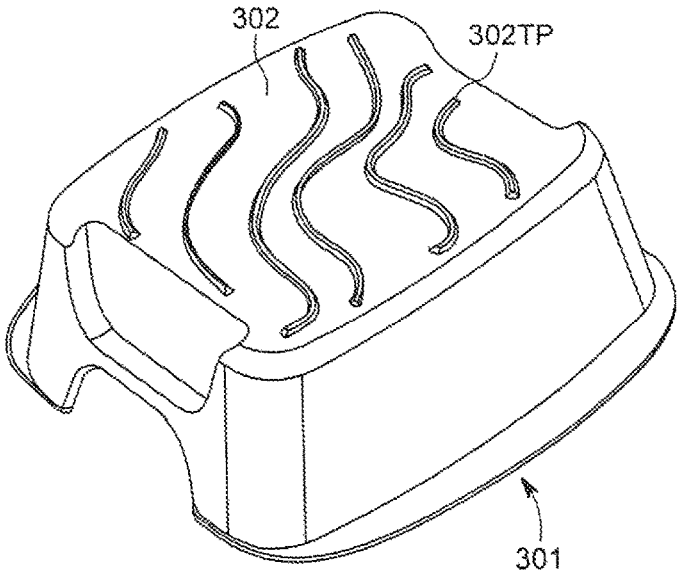
FIG. 29 is a bottom perspective view of the basin of FIG. 14, showing anti-skid waveforms protruding from the bottom of the tub portion of the basin.
Figure 30:
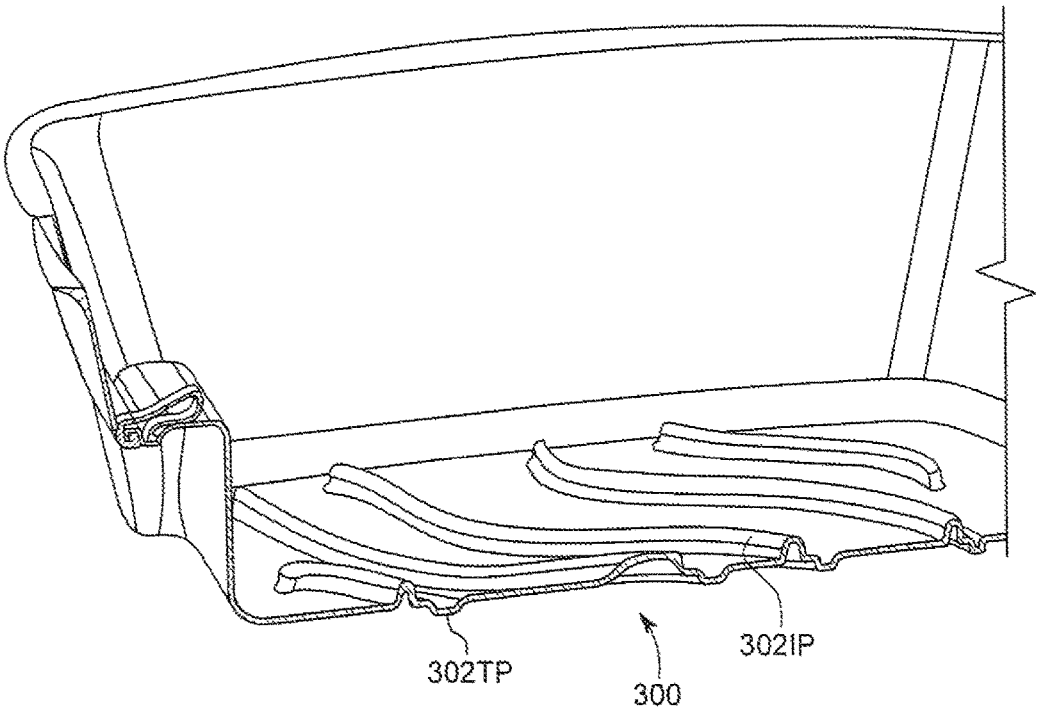
FIG. 30 is a perspective cross-sectional view showing the anti-skid waveforms protruding outward from the bottom of the tub portion of the basin, as seen in FIG. 29, and showing waveform shapes protruding inwardly to form anti-splash baffles.
Figure 31:
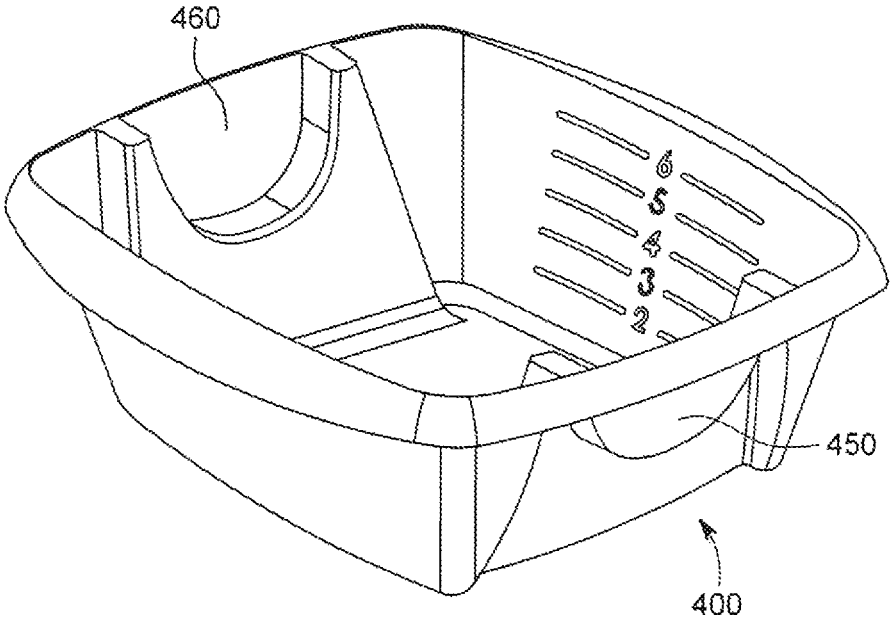
FIG. 31 is a perspective view of a third embodiment of a basin built in accordance with the present invention, having tear-away door panels.
Figure 32:
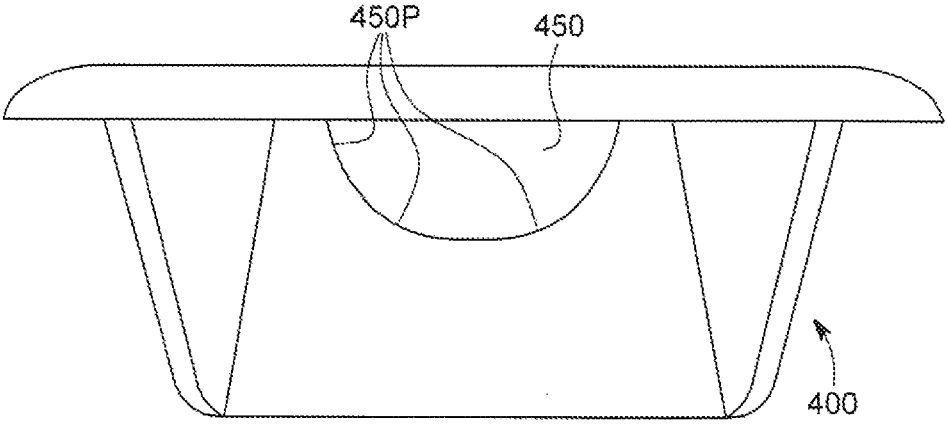
FIG. 32 is an end view of the basin shown in FIG. 31.
Figure 33:
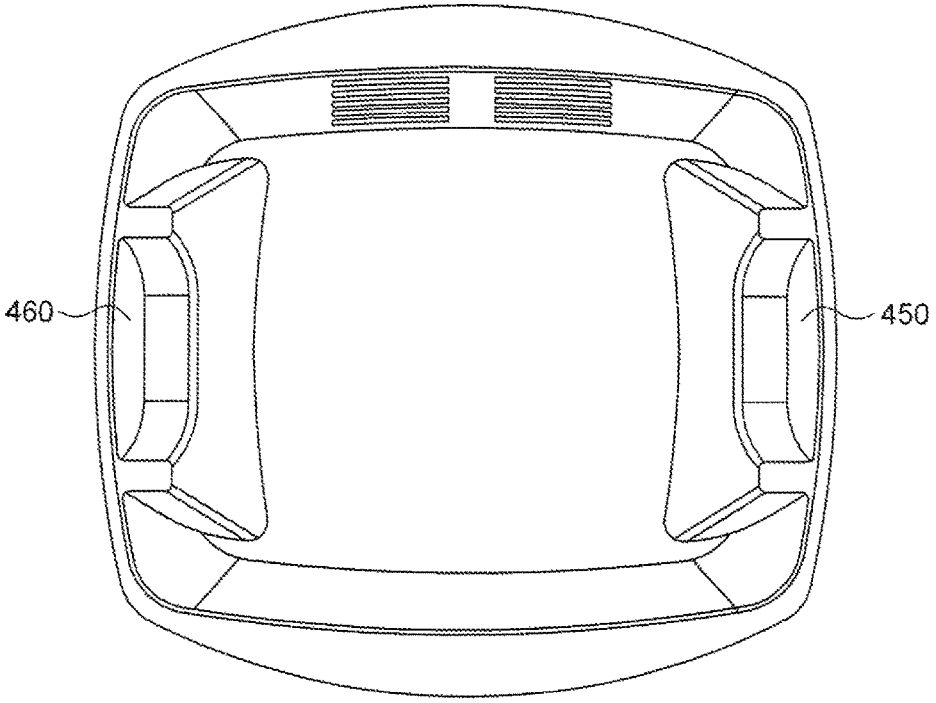
FIG. 33 is a top view of the basin of FIG. 31.
Figure 34:
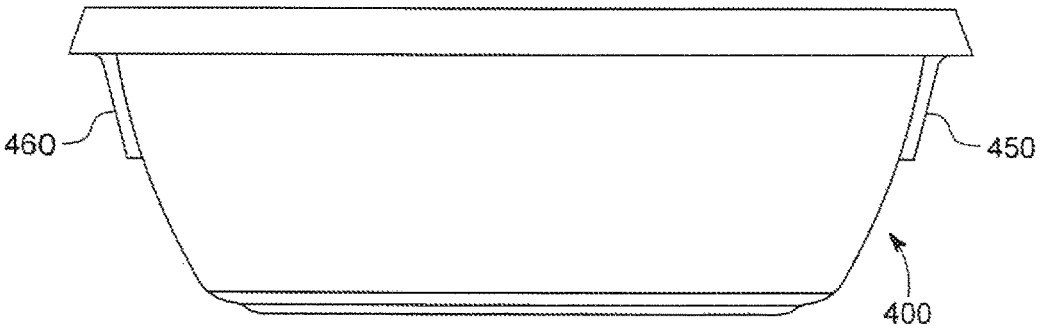
FIG. 34 is a side view of the basin of FIG. 31.

FIG. 29 illustrates that the bottom of the tub 302 of basin assembly 300 may be formed with protruding waveform shapes 302TP that may protrude outward from the bottom of base 301, to provide an anti-slip feature. FIG. 30 also shows the outward protruding waveform shapes 302TP, and additionally shows that waveform shapes 302IP may be formed to protrude inwardly to form anti-splash baffles that may reduce the walk and splash effect.

Figure 15:
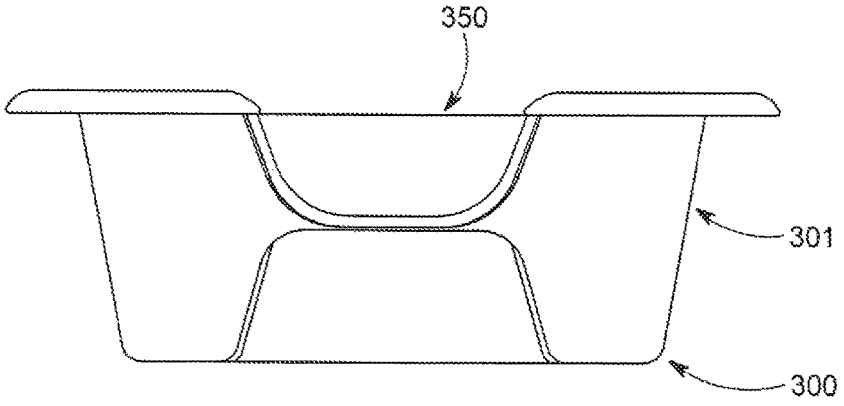
FIG. 15 is an end view of the basin of FIG. 14.
Figure 16:
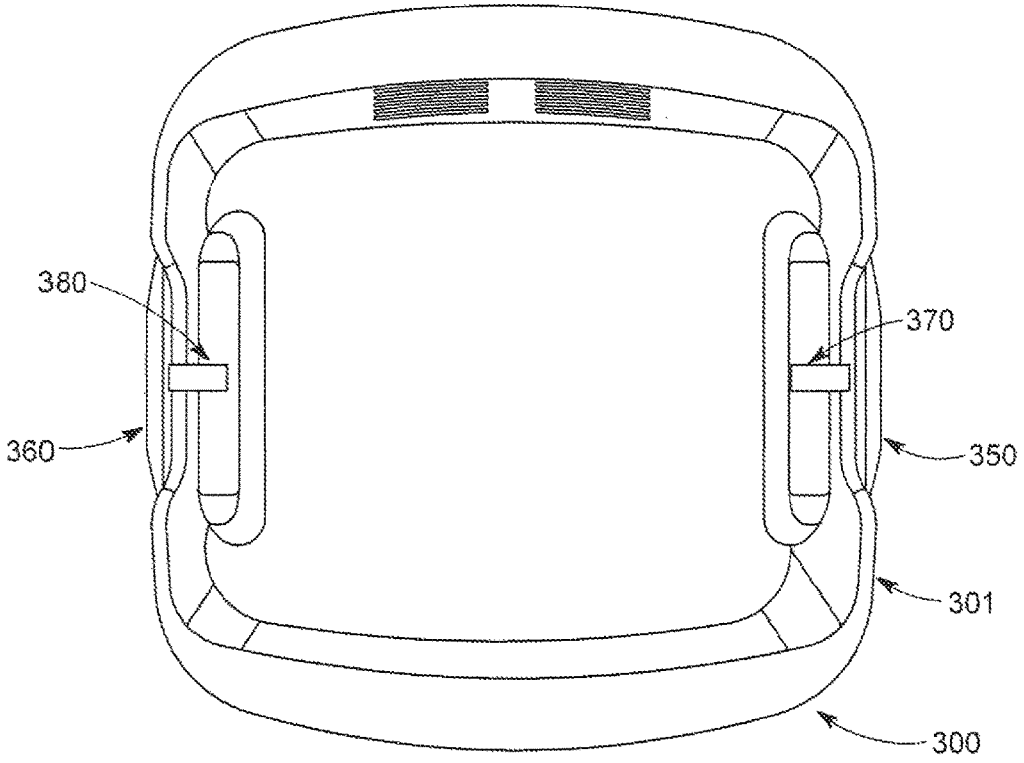
FIG. 16 is a top view of the basin of FIG. 14.
Figure 17:
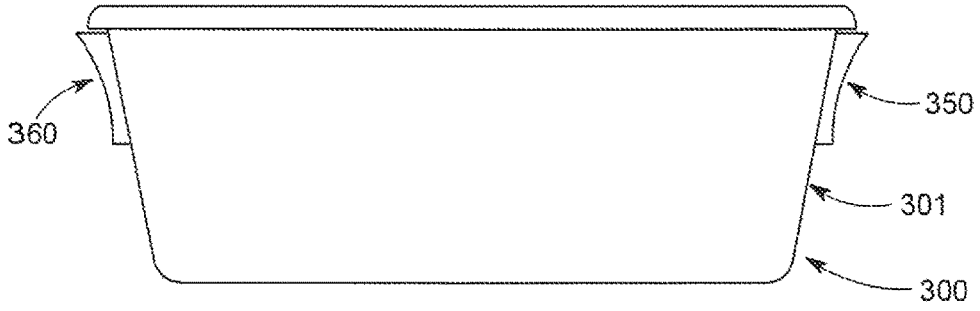
FIG. 17 is a side view of the basin of FIG. 14.

It should be noted that each of the herein disclosed basin embodiments may be formed, to be stackable (i.e., at least wall 303 may be appropriately formed, and may be outwardly angled—see FIG. 15 and FIG. 17). Each of the basin embodiments may also be formed to be sterilizable, and autoclavable.

Figure 35:
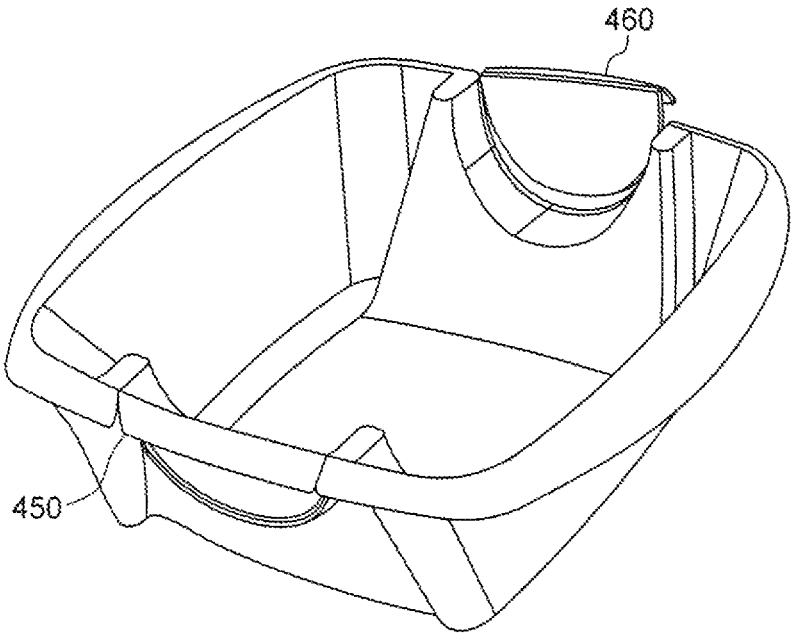
FIG. 35 is a reverse perspective view of the basin of FIG. 31, but shown with one of the tear-away door panels partially removed.
Figure 36:
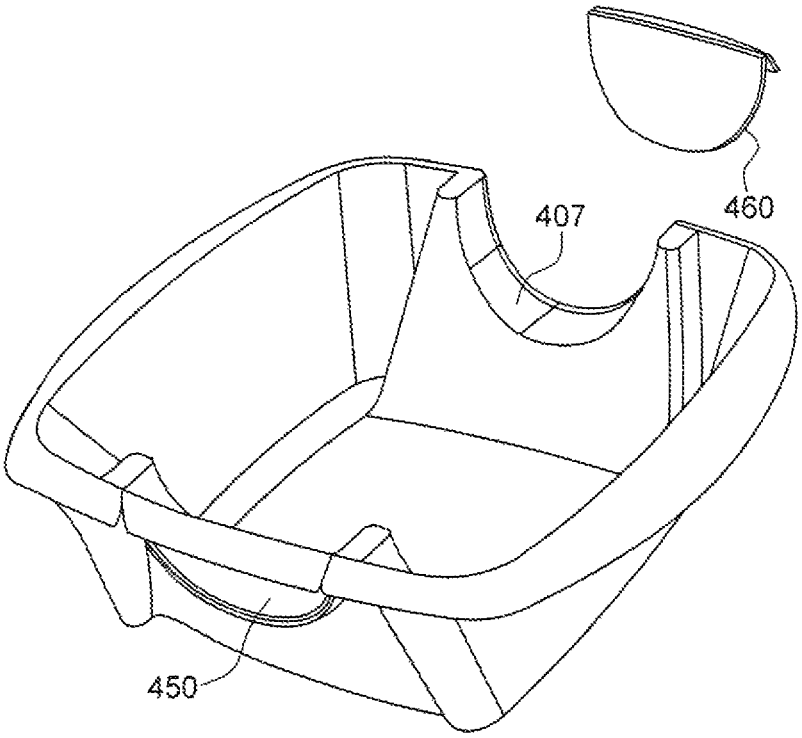
FIG. 36 is a reverse perspective view of the basin of FIG. 31, but shown with one of the tear-away door panels having been completely removed.
Figure 37:
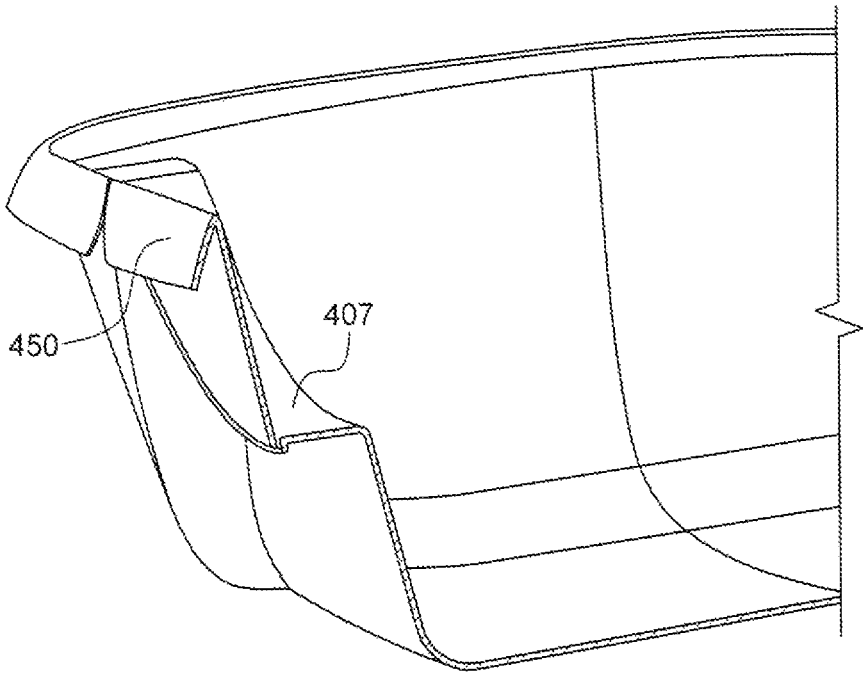
FIG. 37 is a perspective section view through one of the tear-away door panels and the tub of the basin of FIG. 31.
Figure 38:
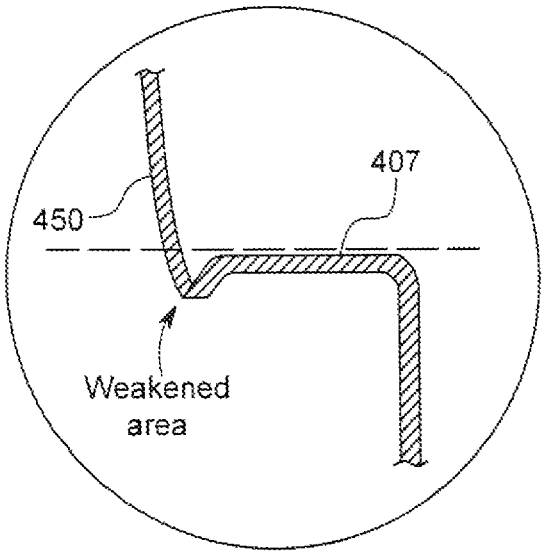
FIG. 38 is a cross-sectional view through one of the tear-away door panels and the tub of the basin of FIG. 31.

FIGS. 31-38 illustrate views of another embodiment of a basin formed in accordance with the present invention. Basin 400 may be formed substantially the same as basin 300, except that instead of having actuable door panels formed as separate parts that may be attached to the tub using an elastomeric spring, it may include a pair of tear-away panels 450/460 that may be integrally formed with the tub. The tear-away panels 450/460 may be formed according to the teachings of U.S. Pat. No. 3,458,080 to Laurizio, the disclosures of which are incorporated herein by reference. The tear-away panels 450/460 may be formed, by creating a weakened zone at the desired periphery tor each panel (i.e., periphery 450P for panel 450), by forming the tub with a notch, therein, or by scoring of the tub along the desired periphery, after the tub is formed. The notch or scoring may be sufficiently deep so that medical personnel possessing even minimal strength may be able to remove the panel, by peeling it away from one of its ends, similar to the pop top on a can of soda. The strength provided by the weakened connection between the panel and the tub, prior to being torn away, should be sufficient to avoid inadvertent tear-out, and should be water-tight FIG. 35 shows panel 460 in the process of being removed, while FIG. 36 shows the panel completely removed. FIGS. 37 and 38 show that the lowermost periphery of each of the panels may preferably be positioned below the top surface of the corresponding inward bulge (e.g., inward bulge 407), so that the patient's limb would be supported by the bulge, and not the flange from where the panel had been torn away.

FIGS. 39-44 illustrate views of another embodiment of a basin formed in accordance with the present invention. Basin 500 may be formed of a tub 501 with an overmolded elastomer. Tub 501 may be formed with a substantially flat base 502, from which may upwardly extend a wall 503. Wall 503 may be integrally formed with base 502, and may be formed as a single continuous member, which, as noted above, may be formed to be any desired shape including a circular shape, a rectangular shape, etc. Merely to be illustrative, a rectangular shape is shown throughout FIGS. 39-44. The wall 503 may have markings 503Mi, 503Mii, etc., integrally formed therein, or stenciled thereon, to indicate the fluid level (e.g., 2 liter, 3 liters, etc.).

Figure 40:
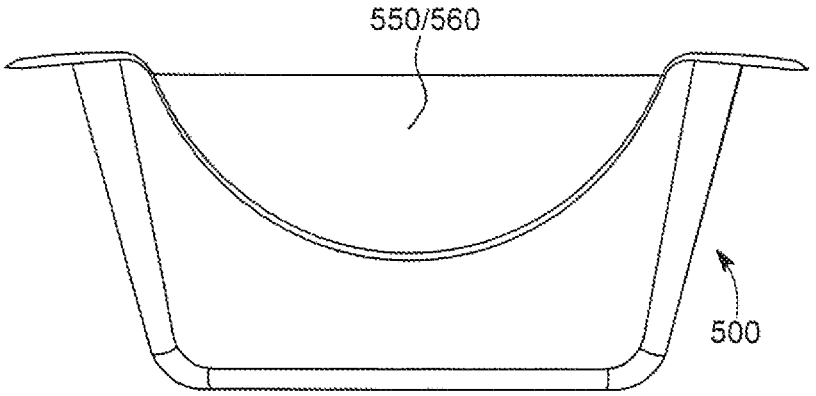
FIG. 40 is an end view of the basin of FIG. 39.
Figure 40A:
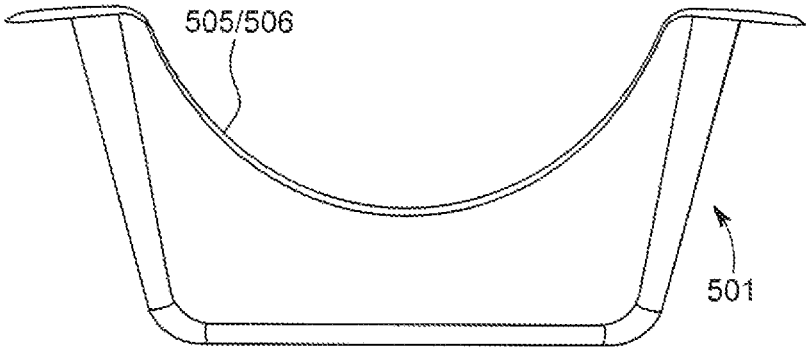
FIG. 40A is the end view of FIG. 40, but shown prior to overmolding of the flexible elastomer end panels onto the reduced height wall areas at each end of the tub.
Figure 41:
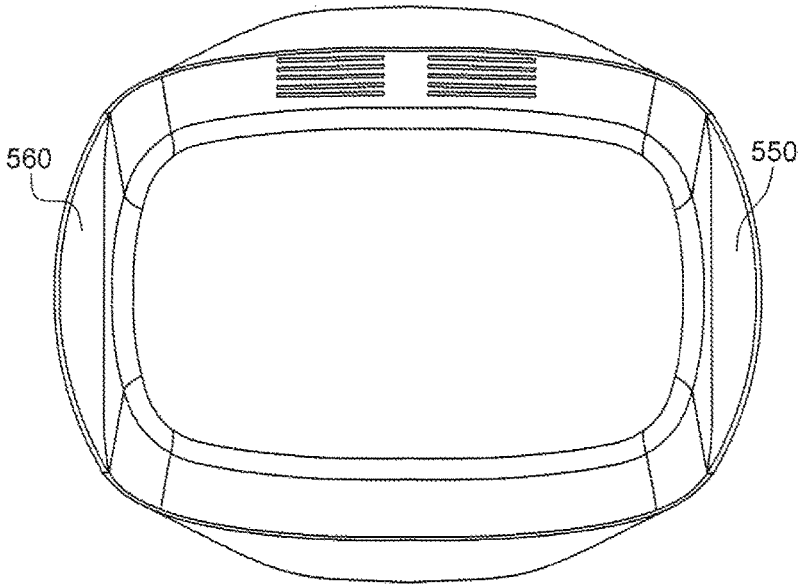
FIG. 41 is a top view of the basin of FIG. 39.
Figure 42:
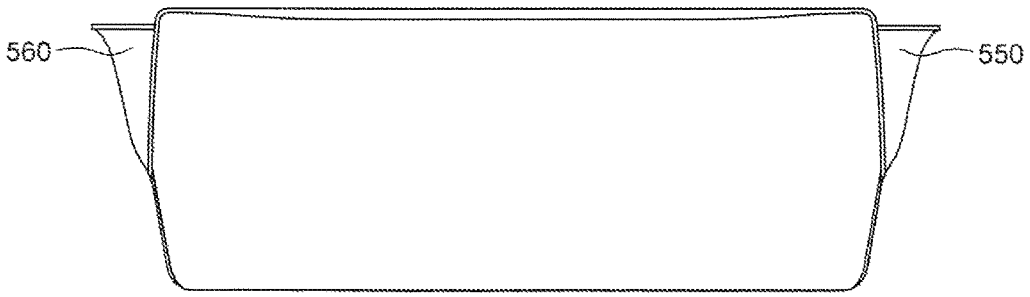
FIG. 42 is a side view of the basin of FIG. 39.

A first set of opposing portions of the top of the wall 503 may have a return flange that forms a first lip 504A and a second lip 504B, which may be used for carrying and handling of the basin assembly 500. The return flange that forms the lip 504A and 504B may gradually reduce in size, until no lip is formed at the top of wall 503. A second set of opposing portions of the wall 503 may not have a lip formed thereat, and each portion may instead have a reduced height wall area 505/506, as seen in FIG. 40A.

Figure 39:
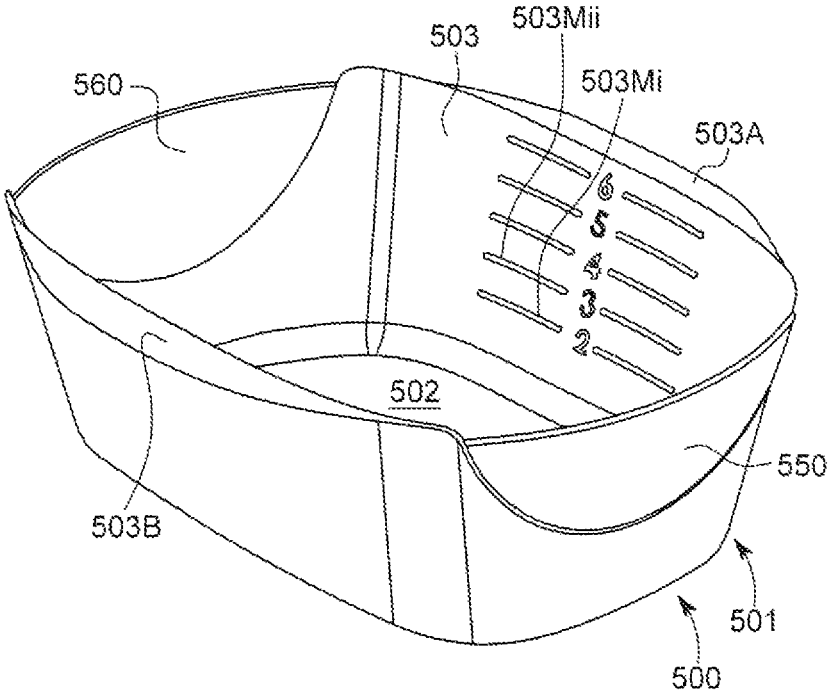
FIG. 39 is a perspective view of a fourth embodiment of a basin built in accordance with the present invention, having elastomeric end panels overmolded with the tub.
Figure 43:
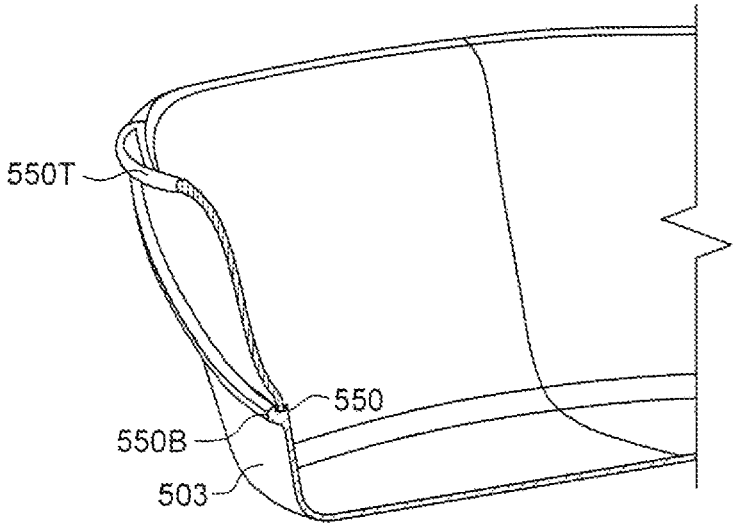
FIG. 43 is a perspective section view through, one of the elastomeric end panels and the tub of the basin of FIG. 39.
Figure 44:
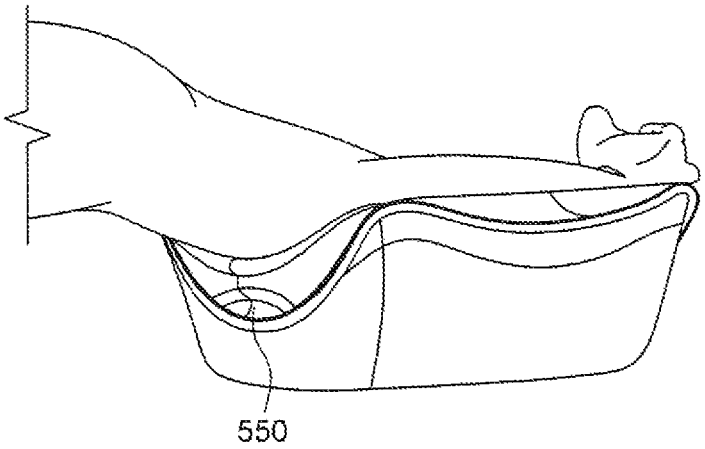
FIG. 44 is a reverse perspective view of the basin of FIG. 39, shown with the elastomeric end panels deforming to conform to, and support, a patient's arm, in preparation for wound irrigation therein.
Figure 45:
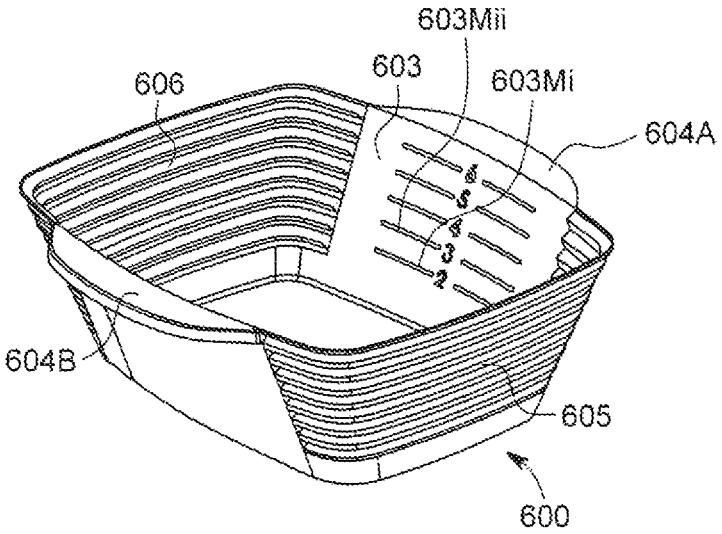
FIG. 45 is a perspective view of a fifth embodiment of a basin built in accordance with the present invention, having accordion-shaped wall portions.
Figure 46:
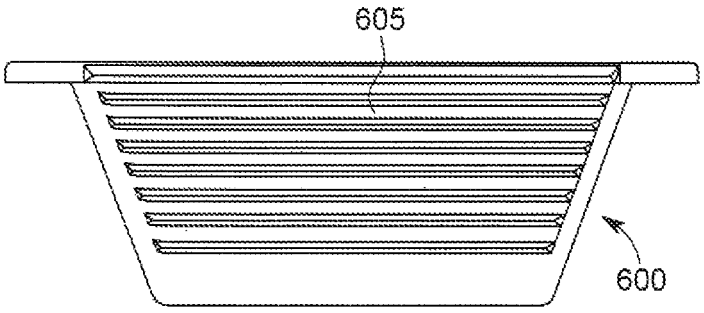
FIG. 46 is an end view of the basin of FIG. 45.
Figure 47:
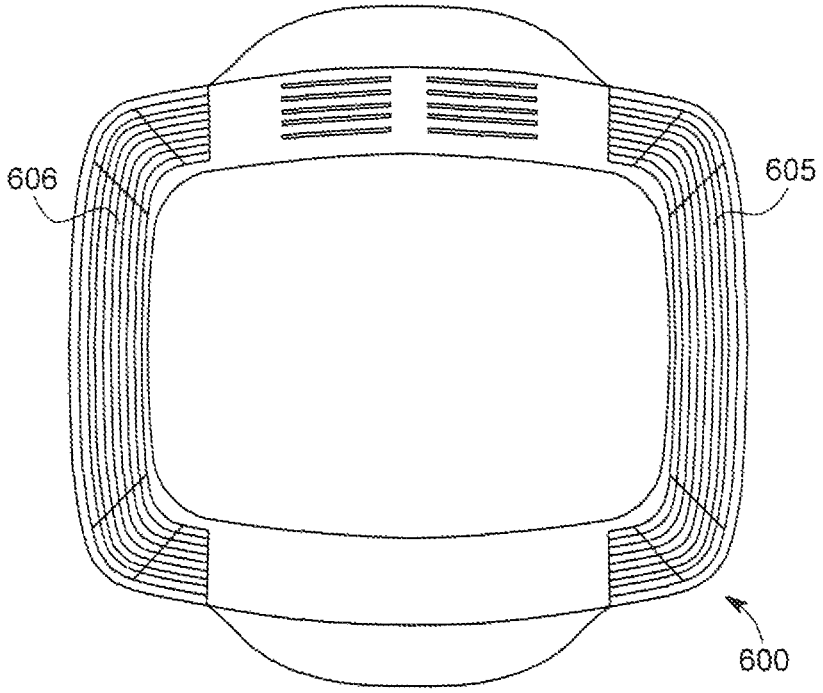
FIG. 47 is a top view of the basin of FIG. 45.
Figure 48:
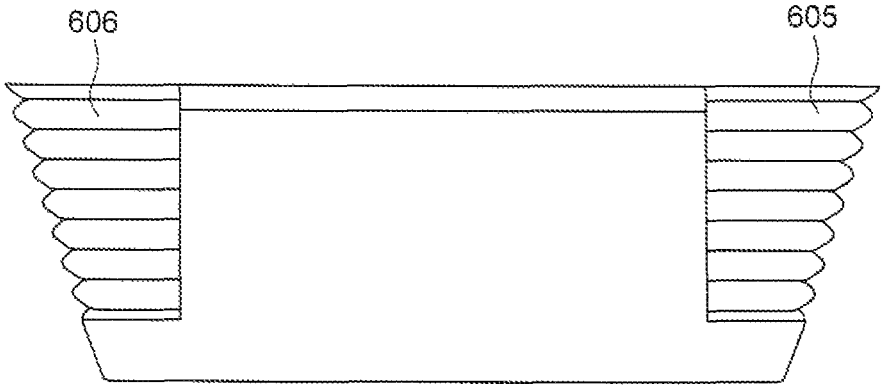
FIG. 48 is a side view of the basin of FIG. 45.
Figure 49:
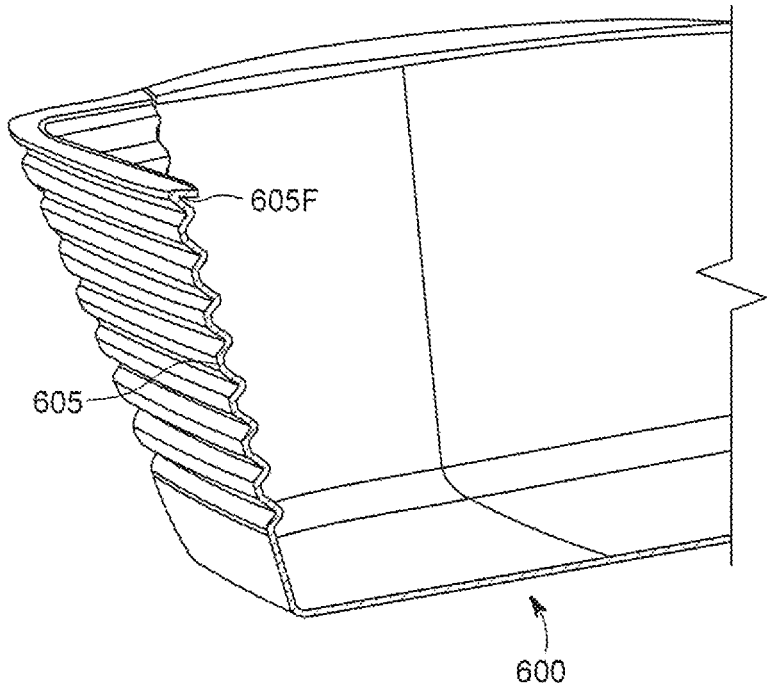
FIG. 49 is a perspective section view through the basin of FIG. 45.
Figure 50:
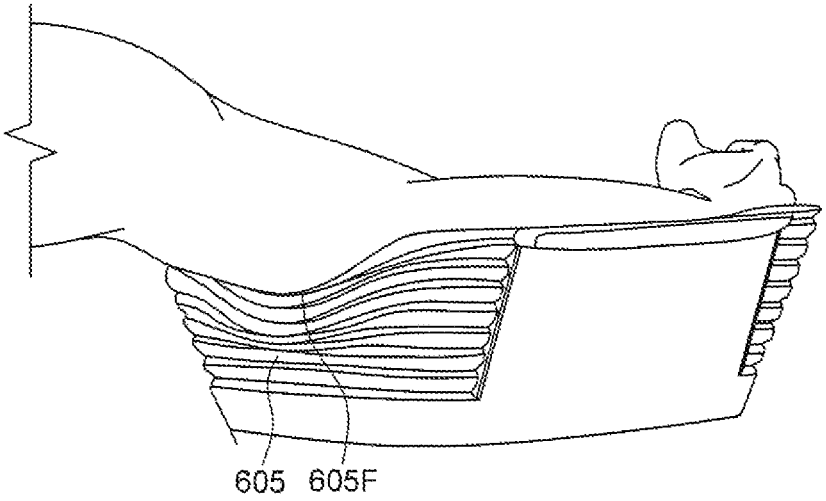
FIG. 50 is a reverse perspective view of the basin of FIG. 45, shown with the accordion end panels deforming to conform to, and support, a patient's arm, in preparation for wound irrigation therein

Each of the reduced height wall areas 505/506 of tub 581 may be semi-circular, or half-moon shaped, or shaped like half of an oval or other similar curved shape. Alternatively, a rectangular shape or even an irregular shape may also be used. The reduced height areas 505/506 may be formed to be different sizes, or may preferably be formed to be the same size, as seen in FIG. 40A, and may be large enough to accommodate the thigh of the 95$^{th}$ percentile man. Each of the reduced height wall areas 505/506 may then be overmolded with a flexible elastomeric materials 550/560, as seen in FIGS. 39-40. As seen in FIG. 43, the reduced height wall areas 505/506 of tub 501 may be formed with a structural bezel (e.g., 550B), which may support the bottom of the overmolded elastomer material (e.g., 550). The top (e.g., 550T) of the elastomer materials may be formed to bow outwardly in a central region, as seen in FIG. 43, which may initially receive the limb of the patient when the basin is to be used for wound irrigation, as illustrated in FIG. 44. The elastomer materials 550/560 may stretch and conform to the patient's limb, and portions of it may also fold under the weight of the limb, to conform to the shape of the limb.

FIGS. 45-50 illustrate views of another embodiment of a basin formed in accordance with the present invention. Basin 600 may be formed with a substantially flat base 602, from which may upwardly extend a wall 603. Wall 603 may be integrally formed with base 602, and may be formed as a single continuous member, which, as noted above, may be formed to be any desired shape including a circular shape, a rectangular shape, etc. Merely to be illustrative, a rectangular shape is shown throughout FIGS. 46-50. The wall 603 may have markings 603Mi, 603Mii, etc., integrally formed therein, or stenciled thereon, to indicate the fluid level (e.g., 2 liter, 3 liters, etc.)

A first set of opposing portions of the wall 603 may have a return flange at a top of the wall that forms a first lip 604A and a second lip 604B, which may be used for carrying and handling of the basin 600. The return flange that forms the lips 604A and 604B may gradually reduce in size, until no lip is formed at the top of wall 603. This first set of wall portions may generally be smooth. A second set of opposing portions 605/606 of the wall 603 may not have a lip formed thereat, and each portion may instead be formed like a bellows (i.e., alternate ridges and grooves), so that the wall areas 605 and 606 seen in FIG. 50 may be easily compressed and may contract like an accordion, and/or may elastically deform as a result of a downward force applied thereat (i.e., the patient's limb). The bellows may thus generally conform to a portion of the shape of the patient's limb. Basin 600 may be formed as a single part using a single material.

The top-most flange of the bellows (e.g., 605F in FIG. 49) for each of the opposing wall portions 605/606 may extend further than each of the other ridges, as it is intended to provide a larger surface area for the comfort of the patient, similar to the inward bulges 307 and 308 of basin assembly 300. The top-most flange may also be formed to be generally parallel to the flat base 601.

To enable greater flexure of the bellows, upon receiving the patient's limb thereon, the bellows of the opposing wall portions 605/606 may be formed to extend through a greater portion of the periphery of the wall 603 than the smoothly formed first set of opposing wall portions. For the square-shaped basin 600 illustrated within FIG. 45, the bellows of the opposing wall portions 605/606 may extend beyond the respective sides of the rectangular shape, and therefore at least a portion of all four sides of the rectangular shape of basin 600 may have the corrugations formed thereon. Analogously, for a basin formed with a generally circular shape (i.e., 360 degrees of curvature), the opposing bellows sections may be formed on more than 180 degrees of the curvature (e.g., 240 degrees of the 360 degrees of curvature, with roughly 120 degrees of bellows on one side and roughly 120 degrees of bellows formed on the opposing side).

The sidewall flexibility provided by the bellows of opposing wall portions 605/606 may thus accommodate various different patient limb sizes and orientations.

Accordingly, it will be apparent to persons skilled in the relevant art that various changes in form and detail can be made therein without departing from the spirit and scope of the disclosure. The breadth and scope of the present disclosure should not be limited by any of the above-described example embodiments, but should be defined only in accordance with the following claims and their equivalents.

What is claimed is:

1. A transformable basin configured to convert from a conventional fluid retaining basin into a wound irrigation basin, said transformable basin comprising:

a base member;

a wall, said wall extending upwardly from said base member; said wall comprising: a first reduced height area, and a second reduced height area, wherein said first reduced height area and said second reduced height area are on opposing portions of said wall; a respective periphery of each of said first and second reduced height areas of said wall comprising a pair of flanges configured to form a lip;

a first door, a portion of a periphery of said first door configured to correspond to said periphery of said first reduced height area of said wall; said portion of said periphery of said first door comprising a seal member fixedly secured thereto, said seal member comprising a pair of flanges that form a lip configured to mate with said lip at said first reduced height area of said wall;

a first elastomeric leaf spring, a first end of said first elastomeric leaf spring fixedly secured to said first opposing wall portion, and a second end of said first elastomeric leaf spring, fixedly secured to said first door, to bias said lip of said seal member of said first door into a sealed position against said lip of said first reduced height area, and to permit said first door to translate and to rotate away from said sealed position into a displaced position relative to said first reduced height area;

a second door, a portion of a periphery of said second door configured to correspond to said periphery of said second reduced height area of said wall; said portion of said periphery of said second door comprising a seal member fixedly secured thereto, said seal member of said second door comprising a pair of flanges that form a lip configured to mate with said lip at said second reduced height area of said wall; and a second elastomeric leaf spring, a first end of said second elastomeric leaf spring fixedly secured to said second opposing wall portion, and a second end of said second eiastomeric leaf spring fixedly secured to said second door, to bias said lip of said seal member of said second door into a sealed position against said lip of said second reduced height area, and to permit said second door to translate and to rotate away from said sealed position at said second reduced height area, into a displaced position relative to said second reduced height area.

2. The transformable basin according to claim 1 further comprising:

means for releasably securing said first door against a first exterior lower portion of said wall in said displaced position of said first door; and means for releasably securing, said second door against a second exterior lower portion of said wall in said displaced position of said second door.

3. The transformable basin according to claim 1 wherein a depth of said first reduced height area of said wall is greater than a depth of said second reduced height area.

* * * * *